US006980749B2

(12) United States Patent
Yoda et al.

(10) Patent No.: US 6,980,749 B2
(45) Date of Patent: Dec. 27, 2005

(54) IMAGE FORMING APPARATUS WITH CONTROL FEATURE BASED ON TRANSFER MATERIAL DISCRIMINATION

(75) Inventors: Yasuo Yoda, Shizuoka-ken (JP); Tatsunori Ishiyama, Shizuoka-ken (JP); Yoichiro Maebashi, Tokyo (JP); Hiroshi Kawaguchi, Shizuoka-ken (JP); Kenichi Iida, Boise, ID (US); Yuki Nishizawa, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 10/669,015

(22) Filed: Sep. 24, 2003

(65) Prior Publication Data

US 2004/0126125 A1 Jul. 1, 2004

(30) Foreign Application Priority Data

Sep. 25, 2002 (JP) ..... 2002-279707
Jun. 27, 2003 (JP) ..... 2003-184744

(51) Int. Cl.[7] ..... G03G 15/00
(52) U.S. Cl. ..... 399/45; 399/66
(58) Field of Search ..... 399/45, 66, 302, 399/308

(56) References Cited

U.S. PATENT DOCUMENTS 6,226,465 B1 * 5/2001 Funatani ..... 399/44

FOREIGN PATENT DOCUMENTS

JP 04305666 A * 10/1992 ..... G03G 15/01
JP 09134079 A * 5/1997 ..... G03G 15/16

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

An image forming apparatus includes a movable image bearing member, a movable intermediary transfer member, wherein an image on the image bearing member is transferred onto the intermediary transfer member by primary transfer and the image transferred onto the intermediary transfer member is transferred onto a transfer material by secondary transfer, a discriminator for discriminating a kind of the transfer material, and a controller for controlling a moving speed ratio between the image bearing member and the intermediary transfer member on the basis of an output of the discriminator.

7 Claims, 11 Drawing Sheets

IMAGE FORMING APPARATUS WITH CONTROL FEATURE BASED ON TRANSFER MATERIAL DISCRIMINATION

FIELD OF THE INVENTION AND RELATED ART

The present invention relates to an image forming apparatus such as a printer, a copying machine, a facsimile apparatus, or the like, and particularly relates to an image forming apparatus utilizing an intermediary transfer member.

As an electrophotographic image forming apparatus, a multicolor image forming apparatus in which a plurality of color toner images are formed on an intermediary transfer member by transferring developer images (toner images) which have been formed on a first image bearing member such as a single or a plurality of photosensitive drums, etc., onto the intermediary transfer member as a second image bearing member and then are further transferred onto a transfer material as a third image bearing member to form a multicolor image, has been put into practical use.

In such a conventional multicolor image forming apparatus, the intermediary transfer member contacts the photosensitive drum at a primary transfer station, and the toner image formed on the photosensitive drum is once transferred onto the intermediary transfer member (photosensitive drum) and then is further transferred from the intermediary transfer member onto the transfer material onto which the toner image is transferred reaches a fixing apparatus by which the toner image is heated and pressed to provide a permanently fixed image.

In the above-mentioned intermediary transfer type multicolor image forming apparatus, for example, different from such a scheme that toner images (of a plurality of colors) which have been transferred onto the photosensitive drum are directly transferred onto the transfer material which has been conveyed by being adsorbed by a transfer material bearing member, such as a transfer belt, followed by superposition of these toner images of a plurality of colors, it is not necessary to adsorb the transfer material by the transfer material bearing member. Further, in the intermediary transfer type multicolor image forming apparatus, the plurality of color toner images formed on the intermediary transfer member are transferred onto the transfer material at the same time, so that there is no limit on conditions as to conveyance of the transfer material. As a result, the image forming apparatus has the advantage that it can utilize envelopes or thick paper as the transfer material.

However, a transfer efficiency is partially lowered at the secondary transfer station in some cases depending on the kind of the transfer material used. If the transfer efficiency of the preceding primary transfer is low, there arises such a phenomenon that the resultant (final) toner image causes a density irregularity or the density irregularity caused at the primary transfer station is accelerated at the secondary transfer station. This phenomenon has been liable to occur in the case of a transfer material providing a lower secondary transfer efficiency, i.e., a transfer material having a surface unevenness.

SUMMARY OF THE INVENTION

A principal object of the present invention is to prevent defective image formed on a transfer material by an image forming apparatus utilizing an intermediary transfer member.

A specific object of the present invention is to optimize a final output image by controlling an image forming method at a primary transfer station in view of an influence of surface properties of the transfer material upon a secondary transfer operation.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described with reference to the drawings.

<Embodiment 1>

Figure 1:
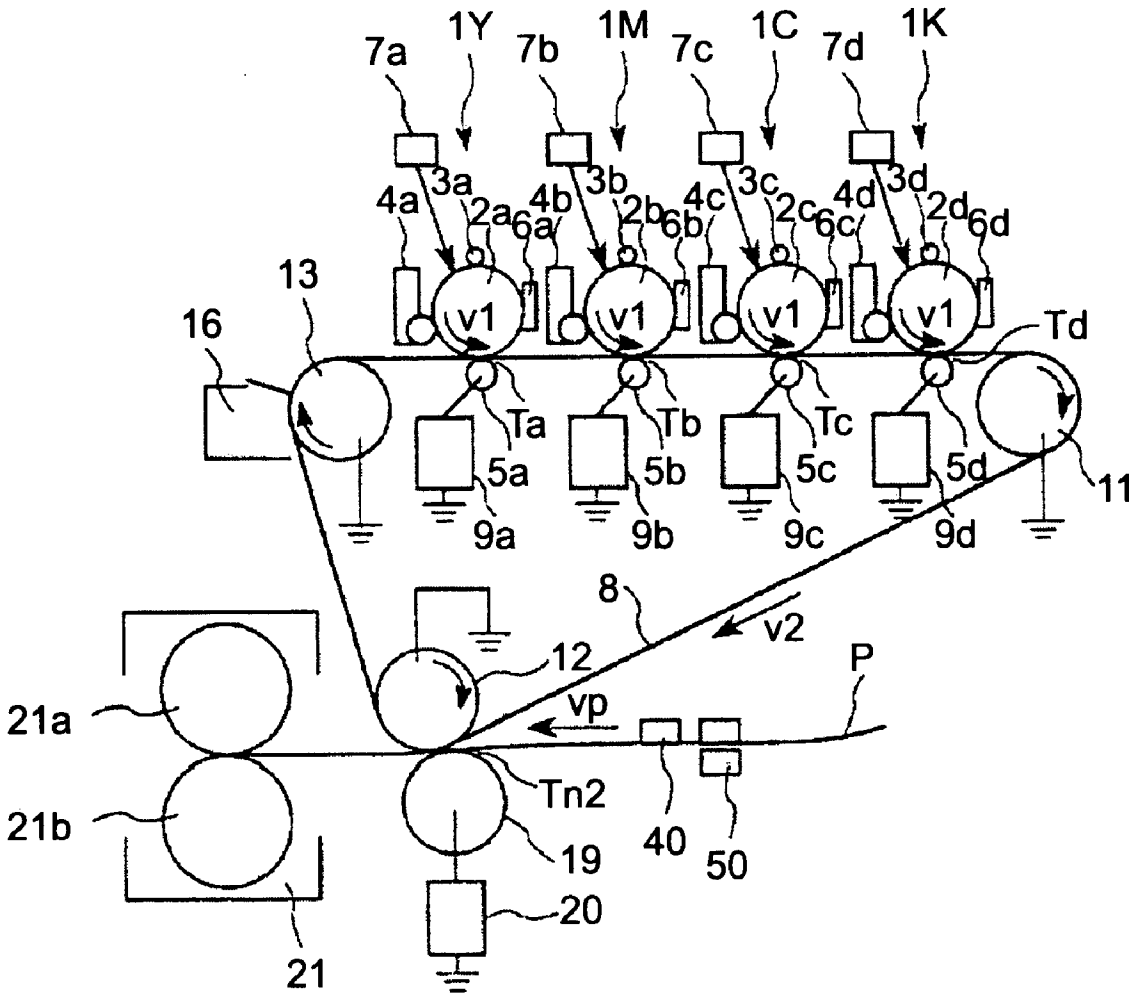
FIGS. 1 and 2 are respectively a schematic sectional vie of the image forming apparatus according to the present invention used in Embodiment 1.

FIG. 1 is a schematic section view of a full-color image forming apparatus (e.g., electrophotographic printer) as an image forming apparatus according to this embodiment.

First, the general structure of the image forming apparatus will be described. Referring to FIG. 1, the image forming apparatus includes four image forming stations (image forming units) consisting of an image forming station 1Y for forming a yellow image, an image forming station 1M for forming a magenta image, an image forming station 1C for forming a cyan image, and an image forming station 1K for forming a black image, disposed in series with a certain spacing.

In the respective image forming stations 1Y, 1M, 1C and 1K, photosensitive drums 2*a*, 2*b*, 2*c* and 2*d* as a first image bearing member are disposed, respectively. Around the respective photosensitive drums 2*a*, 2*b*, 2*c* and 2*d*; there are disposed charge rollers 3*a*, 3*b*, 3*c* and 3*d*; developing apparatuses 4*a*, 4*b*, 4*c* and 4*d*; primary transfer rollers 5*a*, 5*b*, 5*c* and 5*d*; and drum cleaning apparatuses 6*a*, 6*b*, 6*c* and 6*d*, respectively. Above the charge rollers 3*a*, 3*b*, 3*c* and 3*d* and the developing apparatuses 4*a*, 4*b*, 4*c* and 4*d*; exposing apparatuses 7*a*, 7*b*, 7*c* and 7*d* are disposed, respectively.

The photosensitive drums 2*a*, 2*b*, 2*c* and 2*d* are respectively a negatively chargeable organic photosensitive drum which has an outer diameter 30.0 mm and comprises a drum support of, e.g., aluminum, and a photosensitive layer of OPC (organic photoconductor) disposed on the drum support.

The charge rollers 3*a*, 3*b*, 3*c* and 3*d* as a contact charging means contact the photosensitive drums 2*a*, 2*b*, 2*c* and 2*d*, respectively, at a predetermined abutting force.

The developing apparatuses 4*a*, 4*b*, 4*c* and 4*d* are respectively a two component developing type developing apparatus. In the developing apparatuses 4*a*, 4*b*, 4*c* and 4*d*, as a developer, a yellow toner, a magnet toner, a cyan toner and a black toner are accommodated, respectively.

The primary transfer rollers 5*a*, 5*b*, 5*c* and 5*d* contacts the surfaces of the photosensitive drums 2*a*, 2*b*, 2*c* and 2*d*, respectively, at a pressing force of 800 gf, through an intermediary transfer belt 8 as an intermediary transfer member (also a second image bearing member).

The intermediate transfer belt 8 is extended under tension around a drive roller 11, a secondary transfer opposite roller 12, and a follower roller 13 (to be driven by the drive roller 11). As the tension for the intermediary transfer belt 8, a load of 98N is applied to the follower roller 13 by a pressure means (not shown) so that a slip between the intermediary transfer belt 8 and the drive roller 11 does not occur. Incidentally, the drive roller 11, the secondary transfer opposite roller 12 and the follower rollers 13 ar electrically grounded, respectively.

A secondary transfer roller 19 as a contact transfer means contacts the secondary transfer opposite roller 12 through the intermediary transfer belt 8 at a predetermined pressing force.

A fixing apparatus 21 includes a fixing roller 21*a* and a pressure roller 21*b*, and is disposed downstream from the secondary transfer roller 19 and the secondary transfer opposite roller 12 in a direction of a transfer material conveyance direction.

In the image forming apparatus of this embodiment, a reflection type optical transfer material sensor 50 are disposed as transfer material kind detection means at a position where the transfer material passes through before a secondary transfer station. The methods of discriminating the kind of transfer material used by these sensors 40 and 50 are described later.

As described above, the image forming apparatus of this embodiment employs the intermediary transfer member. Next, the intermediary transfer belt 8 will be described in detail. As the intermediary transfer belt 8, it is possible to use, e.g., an elastomer sheet having a structure of a plurality of layers which includes a support sheet and a resinous layer disposed, as a release layer, on an image bearing surface of the support sheet. The support sheet may include films of resins such as a urethane-based resin, a fluorine-containing resin, a nylon resin, and a polyimide resin; resinous films which have been resistance-adjusted by dispersing carbon black or electroconductive powder into the above resins; and rubbers such as urethane rubber and NBR; or the like. In this embodiment, as the intermediary transfer 8, a single layer type endless belt (peripheral length: 1000 mm, thickness: 100 $\mu$m) which has been adjusted to have a volume resistivity $\rho v=1\times10_8$ ohm.cm by dispersing carbon black into polyimide. The volume resistivity is measured according to JIS-K6911. More specifically, a good contact of the belt surface with an electrode is ensured by using the electroconductive rubber as an electrode, and then measurement of the volume resistivity is performed by an ultra-high resistance meter ("R8340A", mdf. By Advantest Corp.) under application of a voltage of 100 V for 30 sec.

In the above-described image forming apparatus sing the intermediary transfer member, as described with respect to the conventional image forming apparatus, it is possible to extend the range of choices of the transfer material used. An image forming operation in such an image forming apparatus will be described below.

When an image forming operation start signal is sent, each of the photosensitive drums 2*a*, 2*b*, 2*c* and 2*d* of the image forming stations 1Y, 1M, 1C and 1K is rotationally driven by a drive apparatus (not shown) in a counterclockwise direction of an arrow at a predetermined moving speed v1 (mm/sec) (about 117 mm/sec in this embodiment).

The charge rollers 3*a*, 3*b*, 3*c* an 3*d* supplied with a charging bias voltage from a charging bias power supply (not shown) electrically charge uniformly the surfaces of the photosensitive drums 2*a*, 2*b*, 2*c* and 2*d*, respectively, to a predetermined negative potential (about −650 V in this embodiment).

Each of the exposing apparatuses 7*a*, 7*b*, 7*c* and 7*d* converts an image signal which has been subjected to color separation and is inputted from a host computer (not shown) into a light signal, and comes and exposes each of the charged photosensitive drums 2*a*, 2*b*, 2*c* and 2*d* to laser light (converted light signal), thus forming an electrostatic latent image corresponding to image information.

Then, to the electrostatic latent image formed on the photosensitive drum 2*a*, a negative(−polarity) developing bias voltage is applied from a developing bias power supply (not shown). The yellow toner is adhered (attached) to the electrostatic latent image by the developing apparatus 4*a* to effect reversal development, whereby the latent image is visualized as a developer image (toner image). In this embodiment, the developing bias voltage comprises a rectangular bias voltage including a DC voltage (−400 V) superposed or biased with an AC voltage (Vpp (peak-to-peak voltage): 1.5 kV, frequency: 3 kHz).

The resultant yellow toner image is transferred from the photosensitive drum 2*a* onto the intermediary transfer belt 8 at a primary transfer station Ta (primary transfer). More specifically, the yellow toner image is primary-transferred onto the intermediary transfer belt 8 which moves (rotates) at a predetermined moving speed v2 in a direction of an arrow in synchronism with the rotations of the photosensitive drums 2*a*, 2*b*, 2*c* and 2*d* by rotational drive of the drive roller 11, by means of a primary transfer roller 5*a* to which a constant voltage-controlled bias voltage of about +200 V is applied.

A moving speed ratio $\gamma$12 between the moving speed v1 (mm/sec) of each of the photosensitive drum 2*a*, 2*b*, 2*c* and 2*d* and the moving speed v2 (mm/sec) of the intermediary transfer belt 8 will be described later.

The intermediary transfer belt 8 onto which the yellow toner image is transferred is moved toward the image forming station 1M by the drive of the drive roller 11. Also at the image forming station 1M, in the same manner as in the case of the yellow toner image, the magenta toner image formed on the photosensitive drum 2*b* is transferred onto the yellow toner image on the intermediary transfer belt 8 at a primary transfer station tb in a superposition manner by a primary transfer roller 5*b* to which a primary transfer bias voltage vt1(V) is applied from a primary transfer bias power supply 9*b*.

Similarly, onto the yellow and magenta toner images transferred and superposed on the intermediary transfer belt 8, the cyan and black toner images formed on the photosensitive drums 2*c* and 2*d* of the image forming stations 1C and 1K are successively transferred and superposed by primary transfer rollers 5*c* and 5*d* supplied with a primary transfer bias voltage vt1(V) from primary transfer bias power supplies 9*c* and 9*d*, respectively, thus forming a full-color toner image on the intermediary transfer belt 8.

The full-color toner images formed on the intermediary transfer belt 8 are transferred onto the transfer material P (secondary transfer). More specifically, the full-color toner images are transferred onto the transfer material P at the same time by the secondary transfer roller 19 supplied with a positive secondary transfer bias (+20 μA in this embodiment) from a secondary transfer bias power supply 20 when the movement of the leading end of the full-color transfer images on the intermediary transfer belt 8 to a secondary transfer station Tn2 between the secondary transfer roller 19 and the secondary transfer opposite roller 12 is timed to the conveyance of the transfer material P to the secondary transfer station Tn2 at a predetermined moving speed vp (mm/sec).

Then, the transfer material P onto which the full-color toner images are transferred is carried to the fixing apparatus, and the full-color toner images are heated and pressed at a fixing nip portion between the fixing roller 21*a* and the pressure roller 21*b* to be heat-fixed on the surface of the transfer material P. The resultant transfer material P is then discharged outside the image forming apparatus to terminate a cycle of image forming operation.

In the above-mentioned primary transfer process, transfer residual toner particles remaining on the photosensitive drums 2*a*, 2*b*, 2*c* and 2*d* are removed and recovered by the drum cleaning apparatuses 6*a*, 6*b*, 6*c* and 6*d*, respectively. Transfer residual toner particles remaining on the intermediary transfer belt 8 surface after the secondary transfer process are removed and recovered by a belt cleaning apparatus 16.

Incidentally, in the above-described image forming apparatus, the direction in which the laser light is scanned is referred to as a "main scanning direction", and the directions of the arrows in which the photosensitive drums 2*a*, 2*b*, 2*c* and 2*d*, the intermediary transfer belt 8, the transfer material P, etc., are moved or rotated are referred to as a "sub scanning direction".

As described above, the image forming apparatus of this embodiment forms a transfer image on the transfer material by primary-transferring the toner image formed on the photosensitive drum as the first image bearing member onto the intermediary transfer member as the second image bearing member and then further secondary-transferring the primary-transferred toner image onto the transfer material P.

The image forming apparatus according to the present invention is characterized in that it includes a control means for controlling (changing) a condition of the primary transfer depending on the kind of the transfer material P used in order to obviate image failures (defective images), such as "banding", "density irregularity", etc., which are liable to occur in the intermediary transfer type image forming apparatus.

Figure 4:
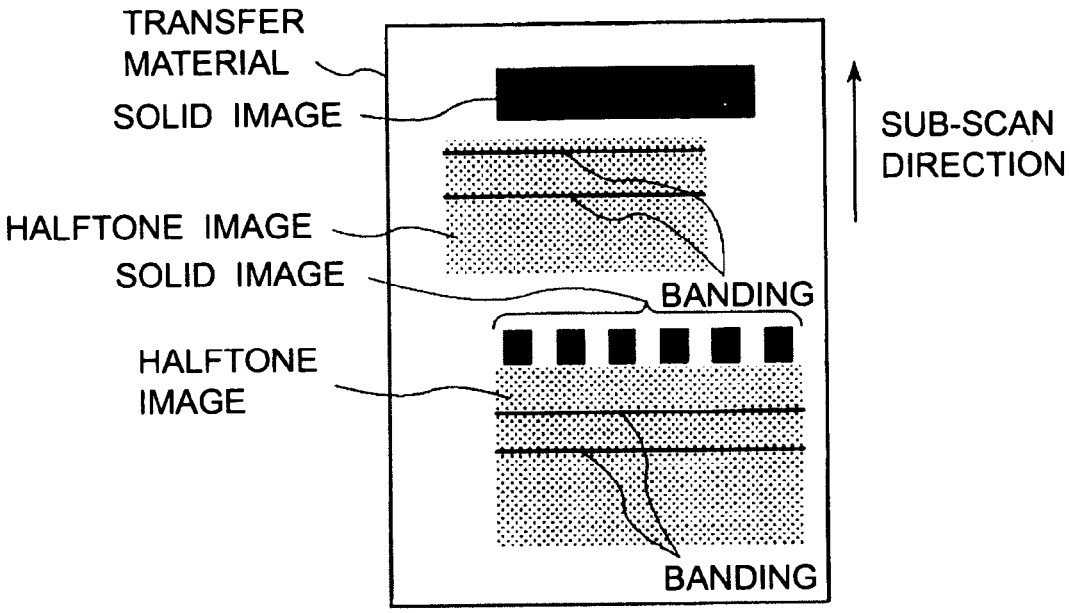
FIGS. 4 and 5 are schematic illustrations of an image failure.
Figure 5:
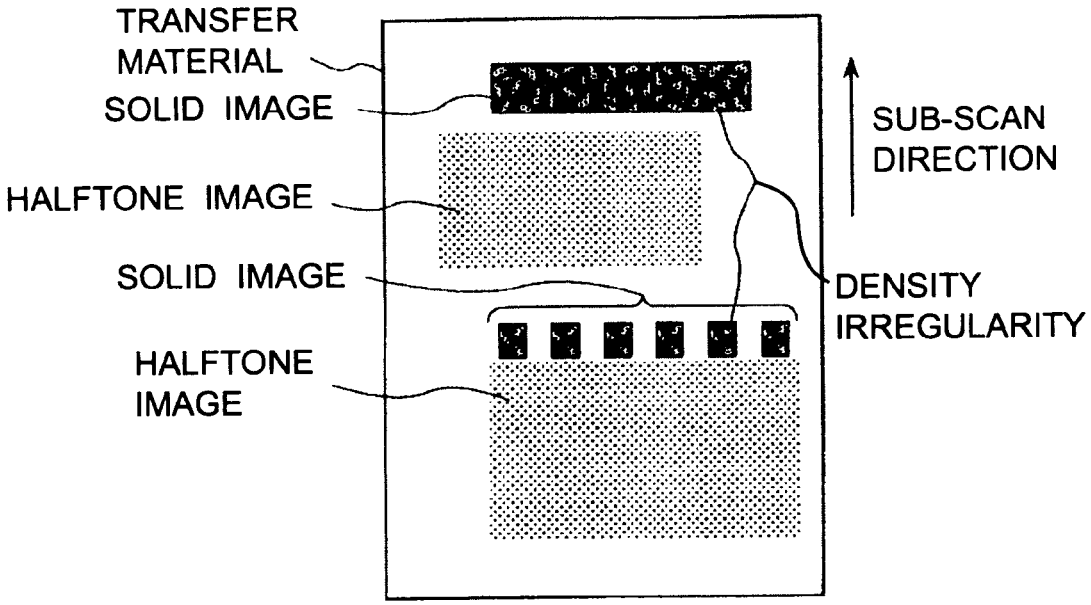

Herein, the "banding" refers to a phenomenon that such images as shown in FIG. 4 are formed, i.e., a stripe-shaped density irregularity occurring at a halftone image portion. This phenomenon is caused, e.g., in the case where a space between halftone dots is changed depending on a fluctuation in speed of a mechanical system, and is frequently caused in the case of using a spot exposure scanning scheme. The "density irregularity" refers to an irregularity in image density occurring at a solid image portion as shown in FIG. 5.

In this regard, there has been proposed such a technique that transfer utilizing such a shearing force that the toner image on the photosensitive drum is scooped is performed by setting a moving speed of the intermediary transfer member surface to be different from a moving speed of the photosensitive drum surface thereby to achieve improvement and stabilization of a transfer efficiency at the time of transferring the toner image from the photosensitive drum onto the intermediary transfer member, thus preventing the density irregularity of the resultant image attributable to a lowering in transfer efficiency.

However, in such a system utilizing a moving speed difference between the photosensitive drum surface and the intermediary transfer member surface, an excessive friction between the photosensitive drum and the intermediary transfer member is liable to occur at the primary transfer nip portion created therebetween, so that movements of the photosensitive drum and the intermediary transfer member become unstable to cause a positional deviation of the toner image formed on the photosensitive drum. As a result positions of the plurality of color toner images to be primary-transferred from the photosensitive drum onto the intermediary transfer member are mutually deviated from each other to cause a so-called "color irregularity". Further, even in the case of forming a monochrome image (single color image), due to this moving speed irregularity, the position of the toner image to be transferred from the photosensitive drum onto the intermediary transfer member is instantaneously deviated from a target position to cause the banding phenomenon within the resultant toner image formed on the intermediary transfer member (particularly at the halftone image portion as shown in FIG. 4).

In this embodiment as described above, the kind of the transfer material P used is detected by the reflection type optical transfer material sensor 40 as the transfer material kind detection means, and a moving speed ratio γ12 between the moving speed of the photosensitive drums 2*a* to 2*d* and the moving speed of the intermediary transfer belt 8, as the condition of primary transfer, is changed.

Hereinbelow, control of the change in moving speed ratio γ12 between the moving speed v1 (mm/sec) of the photosensitive drums 2*a* to 2*d* and the moving speed v2 (mm/sec) of the intermediary transfer belt 8, depending on the kind of the transfer material P, characterizing the image forming apparatus of this embodiment according to the present invention will be described with reference to FIG. 2 which shows an essential portion for such a moving speed ratio control.

In this control, the kind of the transfer material P used is detected by the reflection type optical transfer material sensor 40, and on the basis of the detection results, the CPU 60 (control means) changes the moving speed v1 (mm/sec) of the photosensitive drums 2*a* to 2*d* by controlling a rotational drive of a stepping motor (not shown) as a drive source, thus changing the resultant moving speed ratio γ12 (%) defined as follows:

$$\gamma 12(\%)=[v2(\text{mm/sec})/v1(\text{mm/sec})]\times 100.$$

In this embodiment, the moving speed v2 (mm/sec) of the intermediary transfer belt 8 is not changed. Accordingly, a moving speed ratio (described later) between the moving speed v2 (mm/sec) of the intermediary transfer belt 8 and the moving speed vp (mm/sec) of the transfer material P is not changed by the above-mentioned control, so that the control does not adversely affect the secondary transfer condition.

The reflection type optical transfer material sensor 40 as the transfer material kind detection means is disposed at the position through which the transfer material P in the image forming apparatus passes before the secondary transfer station, and detects a smoothness of the transfer material P surface based on an amount of reflected light from a light incident on the surface of the transfer material P. It has been found that by discriminating the kind of the transfer material P and changing the moving speed ratio γ12 between the moving speed of the photosensitive drums 2*a* to 2*d* and the moving speed of the intermediary transfer belt 8, it is possible to obviate the image failures, such as "banding" and "density irregularity".

Hereinbelow, a specific control method and results in the image forming apparatus shown in FIG. 1 will be described more specifically based on the following Experiments 1 and 2.

Experiment 1

In the image forming apparatus of this embodiment shown in FIG. 1, results of observation of image levels on respective transfer materials P by experimentally changing the moving speed ratio γ12 are shown in Table 1 appearing hereinafter.

In this experiment, as the transfer material P, three types of papers including: (1) plain paper (Xerox 4024; 75 g/m$^2$); (2) coated paper (Future Laser Paper (104 g/m$^2$) and OHP film (Canon TR-3); and (3) bond paper (Plover Bond Paper; 90 g/m$^2$) and laid paper (Neenah Classic Laid Paper; 105 g/m$^2$) were used. In Table 1, "banding" and "density irregularity" were observed on the respective toner materials P as the states shown in FIGS. 4 and 5, respectively.

TABLE 1

| Ratio γ12 | (1) PP*1 | (2) CP*1, OHP*1 | (3) BP*1, LP*1 |
|---|---|---|---|
| 101.25 | Noticeable DI *2 | Good*3 | Very noticeable DI *2 |
| 101.50 | Good*3 | Noticeable banding | Noticeable DI *2 |
| 101.75 | Noticeable banding | Very noticeable banding | Good*3 |

*1PP: plain paper
CP: coated paper
OHP: OHP (overhead projector) film
BP: bond paper
LP: laid paper
*2 DI: density irregularity
*3Good: DI or banding did not occur As shown in Table 1, depending on the kind of the transfer materials P used, the set moving speed ratios γ12 providing a good image level are different.

Experiment 2

The results of Table 1 may be construed as follows.

The levels of surface smoothness of the transfer materials P classified into three types (1) plain paper, (2) coated paper, and (3) bond paper and laid paper, in Table 1. When (1) plain paper is taken as a standard (surface smoothness) level, it is assumed that (2) coated paper and OHP film have a higher surface smoothness, and (3) bond paper and laid paper have a lower surface smoothness.

In this experiment, the surface smoothness values of the respective transfer materials P were actually measured in accordance with JIS-P8119.

The results are shown in Table 2 and substantiate the above assumption.

TABLE 2

| (1) PP | (2) CP | (3) BP | (3) LP |
|---|---|---|---|
| 19 sec. | 369 sec. | 5 sec. | 6 sec. |

Incidentally, (2) OHP film is not measurable by the above-described method, thus being assumed to be one having a very higher surface smoothness than those subjected to measurement.

In Experiment 1, as shown in Table 1, at the moving speed ratio γ12 of 101.50 with respect to (1) plain paper, it is possible to obtain a good image level at which suppressions of occurrences of "banding" and "density irregularity" can effectively be effected in combination. However, it is impossible to suppress "banding" at γ12=101.75 and "density irregularity" at γ12=101.25, with respect to (1) plain paper.

On the other hand, with respect to other two types of the transfer materials P, i.e., (2) coated paper and OHP film and (3) bond paper and laid paper, the setting values of optimum γ12 for compatibly suppressing "banding" and "density irregularity" are different from each other.

This may be attributable to the following reason in view of the results of Table 2 of this experiment (Experiment 2).

The optimum setting value of γ12 is 101.25 with respect to (2) coated paper and OHP film. Compared with (1) plain paper, (2) coated paper and OHP film have smaller surface unevennesses, thus being less liable to cause scattering of toner particles at the time of the secondary transfer. Accordingly, "banding" occurring within a toner image (particularly at the halftone image portion) on the intermediary transfer belt 8 as shown in FIG. 4, is liable to be faithfully reproduced even on these transfer materials. On the other hand, these transfer materials have smaller surface unevennesses, thus ensuring a good transfer efficiency at the time of the secondary transfer. Accordingly, even if "density irregularity" occurs in a toner image (particularly at the solid image portion) on the intermediary transfer belt 8 after the primary transfer, the "density irregularity" does not become worse and further noticeable on the transfer materials after the secondary transfer.

Therefore, with respect to (2) coated paper and OHP film, it is necessary to set a smaller γ12 value (=101.25), than that for (1) plain paper, capable of predominantly realizing the suppression of the "banding" rather than the "density irregularity" in the toner image on the intermediary transfer belt 8.

On the other hand, with respect to (3) bond paper and laid paper, the optimum setting value of γ12 is 101.75. These papers have larger surface unevennesses than (1) plain paper, thus being liable to lower the transfer efficiency at the time of the secondary transfer. As a result, when a total amount of the toner on the transfer materials is large, a toner layer is formed on another toner layer of the transfer materials. Even if such a toner component at the (outermost) surface is removed, light is somewhat adsorbed, so that the change in density is less liable to be recognizable. On the other hand, when the total toner amount of the transfer materials is small, i.e., the transfer efficiency is low, the "density irregularity" is liable to be more recognizable. In other words, the amount of reflected light at a so-called highlight portion becomes large, so that the "density irregularity" is visualized after the secondary transfer, thus being more liable to become worse on the transfer materials P.

On the other hand, these transfer materials having larger surface unevennesses is liable to cause toner scattering or the like at the time of the secondary transfer. As a result, even if the "banding" occurs within the toner image (particularly at the halftone image portion) on the intermediary transfer belt 8, the "banding" is not reproduced faithfully on the transfer materials after the secondary transfer, thus being less noticeable.

Therefore, with respect to (3) bond paper and laid paper, it is necessary to set a larger γ12 value (=101.75), than that for (1) plain paper, capable o predominantly realizing the suppression of the "density irregularity" rather than the "banding".

Figure 3:
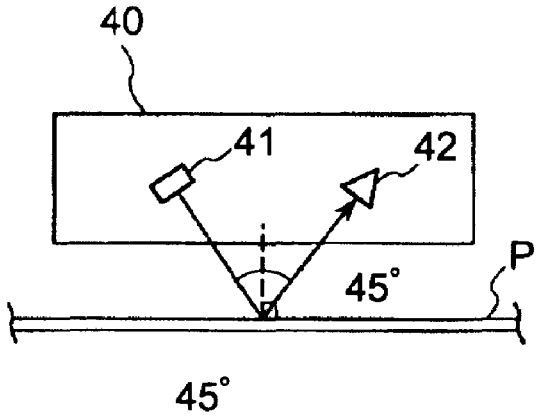
FIG. 3 is a schematic view a reflection type optical sensor 40.

The surface smoothness of the transfer material P is evaluated by utilizing the above-described reflection type light amount sensor. As shown in FIG. 3, in the reflection light amount sensor 40, a light-emitting device 41, such as LED, is disposed so that incident light is incident on the transfer material P surface at an incident angle of 45 degrees, and a light-receiving device 42 such as a photodiode is also disposed at a reflection angle of 45 degrees. The light-receiving device 42 is designed so that the amount of light received is converted into a voltage level, corresponding to the amount of light received, to be outputted, thus allowing detection of the amount of light received a the voltage value. At light receiving portion an aperture width is limited so that the light regularly reflected from the light-emitting device 41 can be selectively received. If the transfer material surface is smooth, a proportion of the regular reflection light to the irregular reflection is large, thus resulting in a high output voltage of the reflection light amount sensor. Accordingly, when the surface of the transfer material, such as (2) coated paper or OHP film, is detected, the output voltage of the reflection light amount sensor becomes large. On the other hand, the transfer material having a larger surface unevenness, such as (3) bond paper or laid paper, has a larger proportion of the irregular reflection light, so that the output voltage of the reflection light amount sensor is lowered. In other words, the level of unevenness of the transfer material can be detected as the level of the output voltage of the reflection light amount sensor, so that the surface properties of the transfer material are detected to control the value of moving speed ratio γ12. The switching of the moving speed ratio will be described later.

Figure 12:
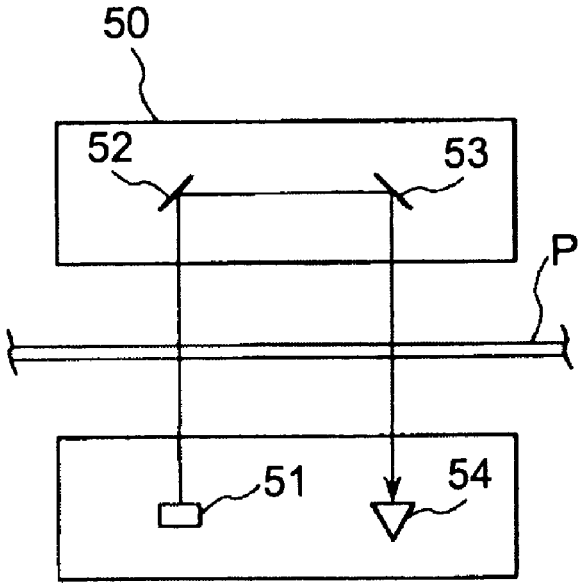
FIG. 12 is a schematic view of a transmission type optical sensor 50.

Further, the OHP film as the transfer material (2) is different in usage from other transfer materials, thus being also different in demand for image qualities in some cases. In such case, by separately using a light transmission type sensor 50, the presence or absence of light transmission of the transfer material when the transfer material passes through the sensor 50, whereby separate judgment can be made particularly with respect to the OHP film. The structure of the light transmission type sensor 50 is shown in FIG. 12. Referring to FIG. 12, a light receiving device 54 can output a voltage value after converting an amount of light received into the voltage value similarly as in the case of the light receiving device 42 of the above-mentioned reflected light amount sensor 40.

In the image forming apparatus of this embodiment, depending on the kinds of the transfer materials detected by the reflection type optical transfer material sensor 40, control of the moving speed ratio γ12 is performed so that the setting value thereof is changed to a value shown in Table 3.

TABLE 3

| | Transfer material | | |
|---|---|---|---|
| | (1) PP | (2) CP, OHP | (3) BP, LP |
| Moving speed ratio γ12 (%) | 101.50 | 101.25 | 101.75 |

As shown in Table 3, with respect to (2) coated paper and OHP film having higher surface smoothness, the moving speed ratio γ12 is set to a value which is smaller than that for the plain paper and is closer to the same speed (γ12=100%), an irregularity in moving speed is suppressed to improve the level of "banding" without accentuating the "density irregularity" at the time of the secondary transfer.

On the other hand, with respect to (3) bond paper and laid paper, the moving speed ratio γ12 is set to be larger than that for the plain paper, whereby the primary transfer efficiency is improved to remedy the "density irregularity" without accentuating the "banding" at the time of the secondary transfer.

As described above, in the image forming apparatus of this embodiment, such a control that the moving speed ratio γ12 is changed so that the γ12 value for the higher surface smoothness transfer material is lower than that for the plain paper and the γ12 value for the lower surface smoothness transfer material is higher than that for the plain paper, depending on the kind of transfer materials, i.e., the difference in surface smoothness in this embodiment, detected by the transfer material kind detection means provided in the image forming apparatus, is performed, thus allowing suppression of the "banding" and "density irregularity" to good levels.

Incidentally, as described above, in the image forming apparatus of this embodiment, such a change control of the moving speed ratio γ12 is effected by changing the moving speed v1 (mm/sec) of the photosensitive drum while fixing the moving speed v2 (mm/sec) of the intermediary transfer belt 8. Accordingly, even if the moving speed ratio γ12 is changed, such an advantage that there is no influence on the secondary transfer station can be attained.

On the other hand, in order to change γ12, when the v2 (mm/sec), not the v1 (mm/sec) is changed, a similar effect is achieved but the moving speed ratio between the moving speed v2 (mm/sec) of the intermediary transfer belt and the moving speed vp (mm/sec) of the transfer material is also changed, so that the change of the vp (mm/sec) is also required together with the change of the v2 (mm/sec), thus complicating the control method.

This embodiment is identical to Embodiment 1 except that the manner of discrimination of the kind of transfer material used is different from that employed in the image forming apparatus of Embodiment 1.

Accordingly, only such a different point will be described with reference to FIG. 6 in which members and symbols identical to those in FIG. 2 have the same functions as in FIG. 2.

Figure 6:
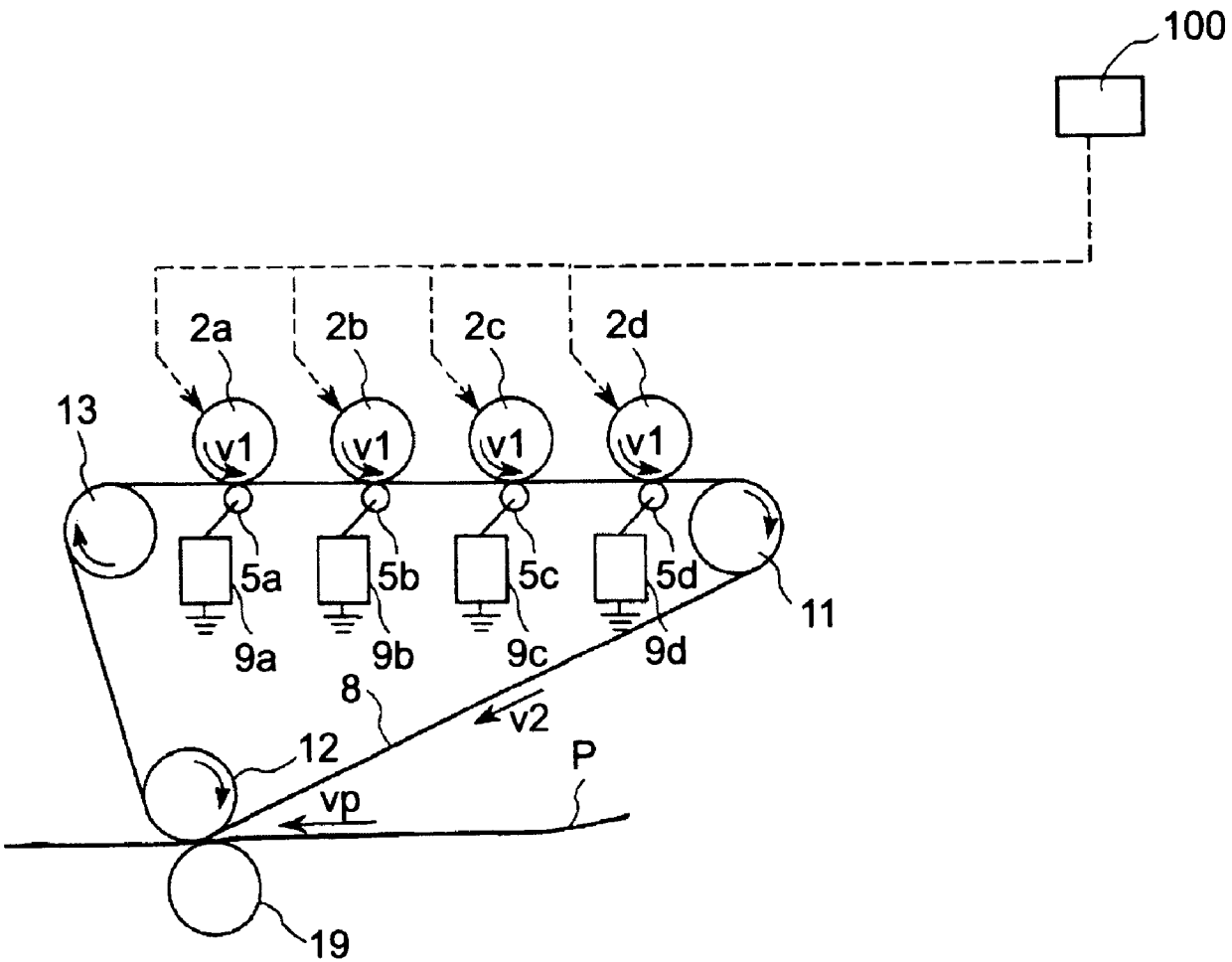
FIGS. 6–10 are schematic sectional views of the image forming apparatuses of the present invention used in Embodiments 2–6, respectively.

Referring to FIG. 6, an image forming apparatus includes an input means 100 for inputting transfer material information. Into the input means 100, information on the kind of the transfer material is set in advance by a user. In this embodiment, the transfer material information input means 100 is illustrated as an independent input means but includes also such a case that the operation panel of the copying machine (image forming apparatus) has also the function as the transfer material information input means.

The transfer material information input means 100 is designed so as to permit classification of the surface properties of the transfer material, so that it is possible to input the distinction among the transfer materials, such as glossy paper, OHP film, etc. When the transfer material information is inputted into the transfer material information input means 100, based on the inputted information, the moving speed ratio γ12 is controlled in the same manner as in Embodiment 1.

<Embodiment 3>

Figure 2:
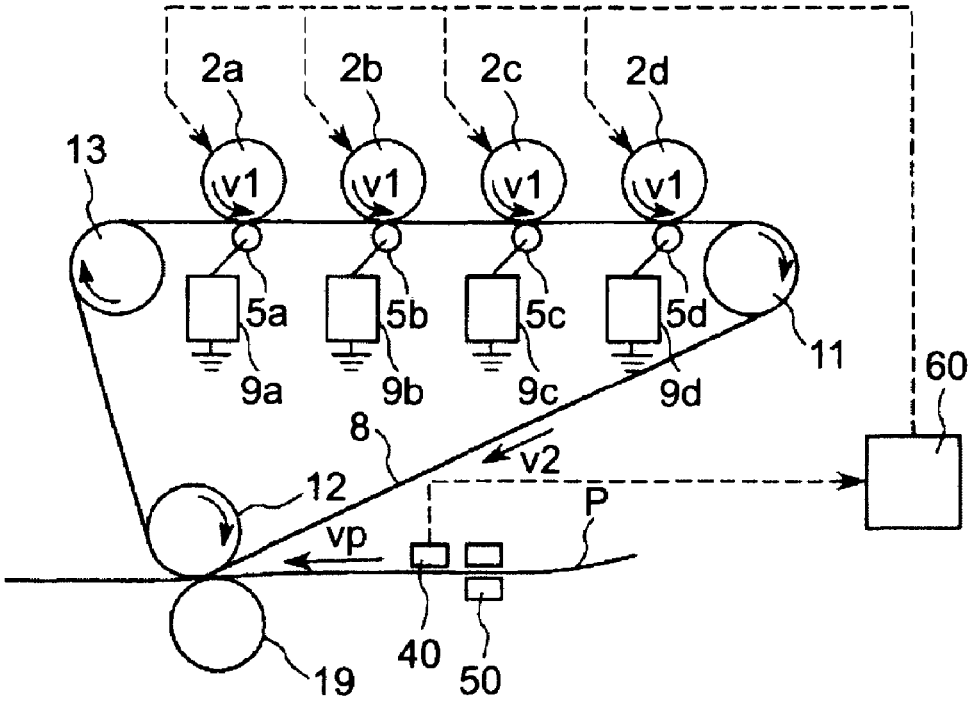
Figure 7:
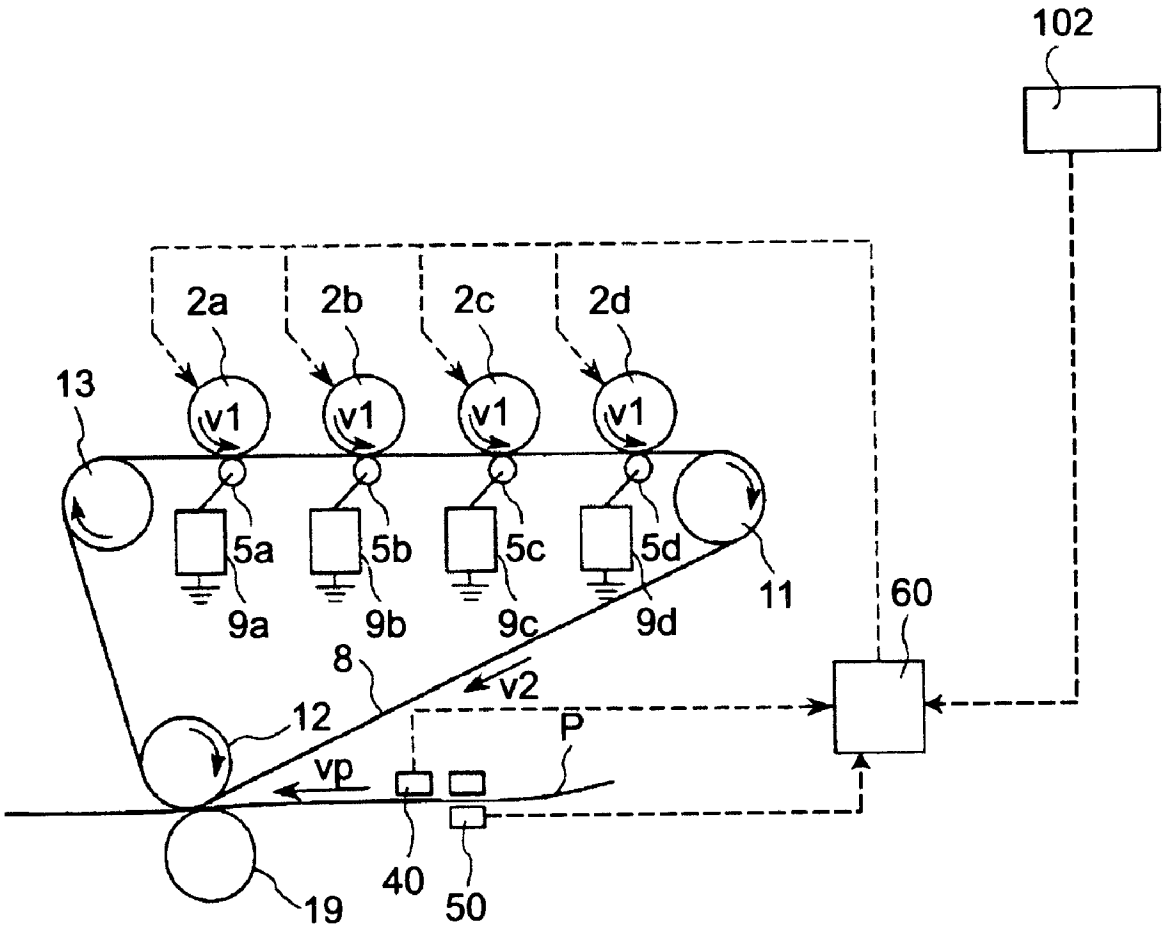

A third embodiment of the image forming apparatus of the present invention will be described with reference to FIG. 7, wherein reference numerals and symbols identical to those in FIG. 2 represent the same members and functions and explanations therefor are omitted.

In this embodiment, the image forming apparatus further includes a detection means 102 for detecting ambient temperatures and/or humidities both inside and outside the image forming apparatus, and on the basis of the detection results, the above-mentioned moving speed ratio γ12 is changed.

In the case where the ambient temperatures and humidities both side and outside the image forming apparatus are a low-temperature/low-humidity environment (e.g., 15° C./10% RH), compared with a normal environment (e.g., 23° C./60% RH) or a high-temperature/high-humidity environment (e.g., 30° C./80% RH), the toner image has a large amount of electric charge per unit weight to increase flowability of the toner. As a result, a cohesive force between toner particles is lowered, so that the amount of the residual toner remaining on the photosensitive drum in the primary transfer process is not stabilized to worsen the level of "density irregularity".

Accordingly, in this embodiment, in accordance with the detection results of the temperature and humidity detection means, the moving speed v1 of the photosensitive drums 2*a* to 2*d* is changed. In the low-temperature/low-humidity environment, the moving speed ratio γ12 is changed to be larger than that in the normal environment, thus preventing the level of "density irregularity" from becoming worse. Further, in the high-temperature/high-humidity environment, the moving speed ratio γ12 is changed to be smaller than that in the normal environment, thus improving the level of "irregularity in color" without worsening the level of "density irregularity".

In this embodiment, the moving speed ratio γ12 in the respective environments is controlled so that its value is determined by the following equation:

$$\gamma 12=\alpha\times\beta,$$

wherein values α and β are those shown below:

(α values)

| Transfer material | | |
|---|---|---|
| (1) PP | (2) CP, OHP | (3) BP, LP |
| 100.25 | 100.00 | 100.50 |

(β values)

| | Temperature t (° C.) | | | |
|---|---|---|---|---|
| Humidity h (% RH) | t < 15 | 15 ≦ t < 23 | 23 ≦ t < 30 | 30 ≦ t |
| h < 10 | 1.0175 | 1.0150 | 1.0150 | 1.0125 |
| 10 ≦ h < 40 | 1.0150 | 1.0150 | 1.0125 | 1.0125 |
| 40 ≦ h < 80 | 1.0150 | 1.0125 | 1.0125 | 1.0100 |
| 80 ≦ h | 1.0125 | 1.0125 | 1.0100 | 1.0075 |

As described above, in this embodiment, the image forming apparatus includes the detection means 102 for detecting ambient temperatures and humidities both inside and outside the image forming apparatus. Depending on the detection results obtained in advance of image formation, the moving speed ratio γ12 is changed, so that it is possible to suppress the "density irregularity" and "color irregularity" both at good levels.

Further, in this embodiment, the moving speed ratio γ12 is changed by changing the moving speed v1 of the photosensitive drums 2*a* to 2*d* but a similar effect can be attained by changing the moving speed ratio γ12 through the change in the moving speed v2 of the intermediary transfer belt 8

<Embodiment 4>

Figure 8:
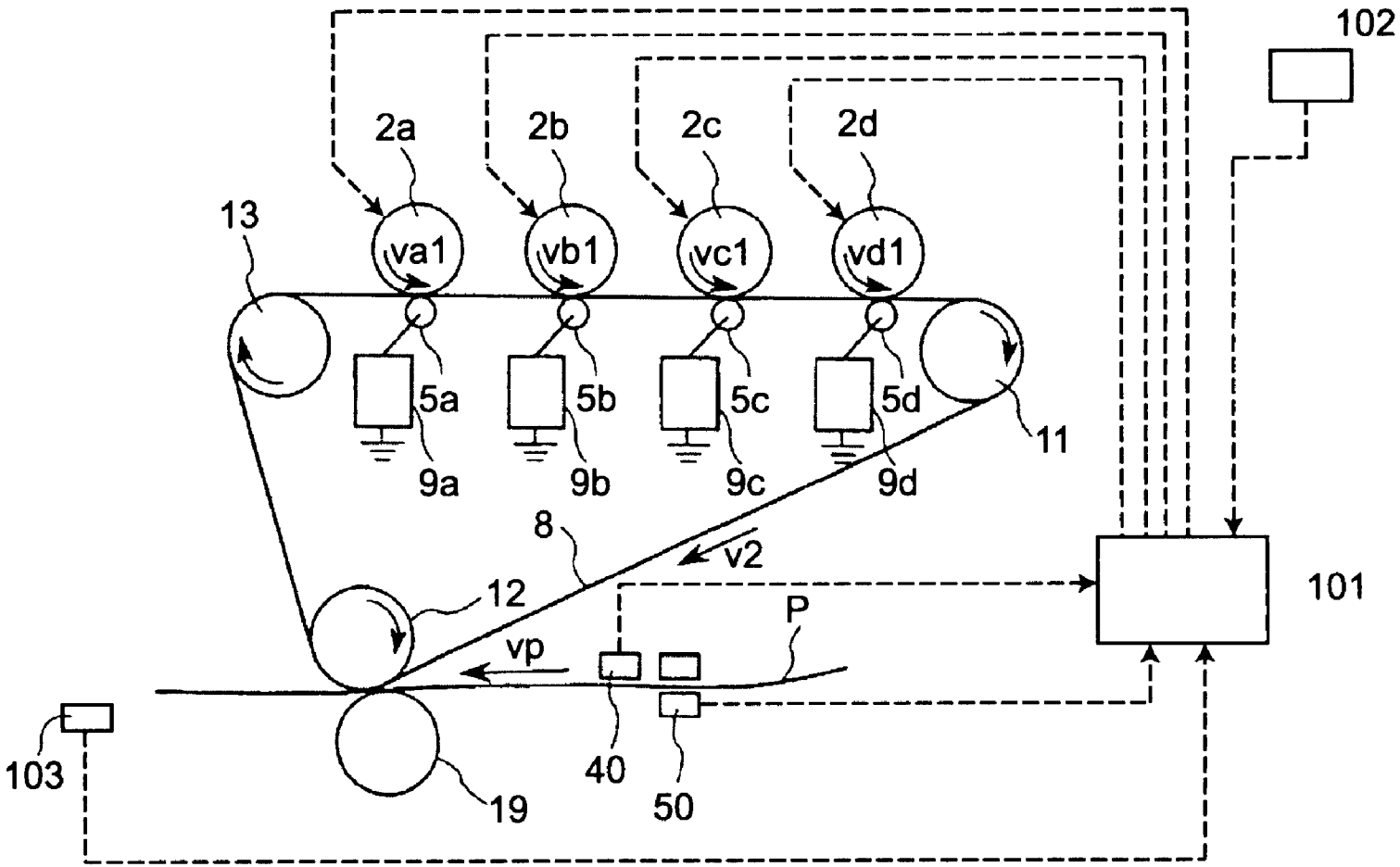

A fourth embodiment will be described with reference to FIG. 8, which illustrates a schematic structure of an image forming apparatus according to this embodiment. In FIG. 8, identical reference numerals and symbols are used for describing identical members and functions as in the preceding embodiments and explanations therefor are omitted.

In this embodiment, the moving velocities of the respective photosensitive drums are changed to change the resultant moving speed ratios with the moving speed of the intermediary transfer member.

The photosensitive drums 2*a*, 2*b*, 2*c* and 2*d* are rotationally driven by drive apparatus (not shown) in a counterclockwise direction (the direction of arrows) at moving velocities va1, vb1, vc1 and vd1, respectively, as the moving speed v1. Moving speed ratios γ12*a*, γ12*b*, γ12*c* and γ12*d* between the respective photosensitive drums 2*a* to 2*d* and the intermediary transfer belt 8 at the respective image forming stations are determined according to the following equations, respectively:

$$\gamma 12a=(v2/va1)\times 100(\%),$$

$$\gamma 12b=(v2/vb1)\times 100(\%),$$

$$\gamma 12c=(v2/vc1)\times 100(\%), \text{ and}$$

$$\gamma 12d=(v2/vd1)\times 100(\%).$$

The control of the moving velocities of the plurality of photosensitive drums 2*a* to 2*d* is performed by rotationally driving the photosensitive drums 2*a* to 2*d* with a plurality of stepping motors (not shown) which are controlled by a CPU 101.

The change in moving velocities of the photosensitive drums 2*a* to 2*d* is realized by the CPU 101 which appropriately select the moving speed ratios Y12*a*, Y12*b*, Y12*c* and Y12*d* on the basis of information of the temperature and humidity detection means 102 and a fed paper counting means 103 and then changes the control velocities of the above-mentioned plurality of stepping motors, respectively. The plurality of color toners used in the multi-color image forming apparatus of this embodiment are different in amount of electric charge per unit weight for each color, and the change in charge amount per unit weight of the toner with the number of image formation is also different for each color. For example, the black toner contains carbon black, so that the toner per se has a low volume resistivity. As a result, the charge amount per unit weight of the black toner is low, thus worsening the level of "hollow image" compared with other color toners. Further, the black toner, compared with other color toners, exhibits a degree of worsening of the level of "hollow image" in the high-temperature/high humidity environment relative to that in the normal environment, and abruptly worsen the level of "hollow image" due to increase in number of image formation.

Accordingly, in this embodiment, the moving velocities va1, vb1, vc1 and vd1 are independently changed so that the resultant moving speed ratios γ12*a*, γ12*b*, γ12*c* and γ12*d* can be separately set, respectively, depending on the levels of "hollow image" at the respective image forming stations, whereby such a control that the "hollow image", "density irregularity" and "color irregularity" are effectively suppressed while minimizing the level of "banding" is realized.

Figure 13:
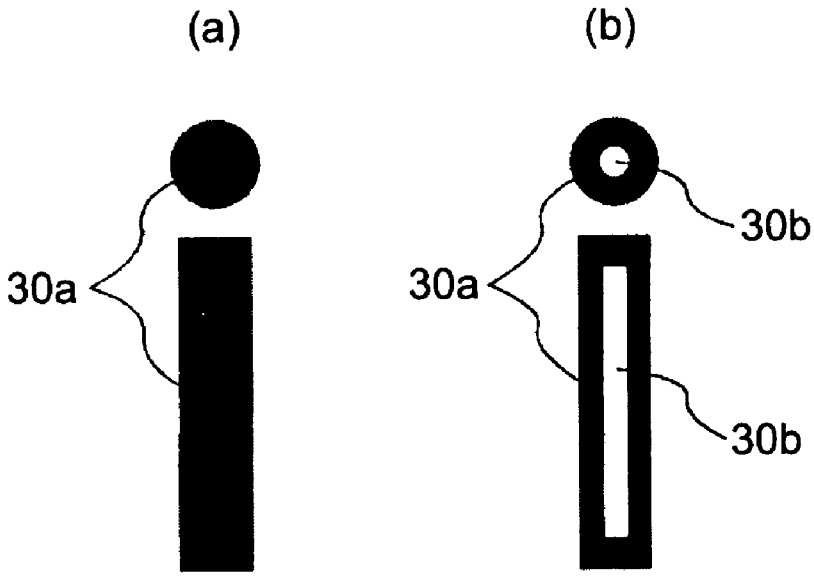
FIG. 13 is a schematic illustration of an image failure.

Herein, the "hollow image" is shown in FIG. 13. FIG. 13(*a*) shows an output image with no "hollow image" and FIG. 13(*b*) shows an output image in which the "hollow image" occurs. As a means for preventing the "hollow image", such a transfer operation that the moving speed of the intermediary transfer member surface is made different from that of the photosensitive drum to create a shearing force for scooping the toner image on the photosensitive drum is performed. Accordingly, in this embodiment, the control is made also in view of prevention of the "hollow image". More specifically, the moving speed ratio γ12 is set also in view of the "hollow image" prevention.

Further, the control is performed so that with the increasing number of image formation, the moving speed ratios γ12*a*, γ12*b*, γ12*c* and γ12*d* are changed on the basis of information of the fed paper counting means 103.

In this embodiment, the moving speed ratio γ12*d* at the image forming station 1K for the black toner always set to be larger by 0.25 than other moving speed ratios γ12*a*, γ12*b* and γ12*c*, and the values of γ12*a*, γ12*b*, γ12*c* and γ12*d* are increased with the number of image formation, whereby it becomes possible to improve the "hollow image" level of the black toner up to a level equivalent to those of other color toners while keeping the "banding" levels of other color toners. Further, the "banding" level is also little worsened.

As described above, in this embodiment, the moving speed ratios (%) of γ12*a*, γ12*b*, γ12*c* and γ12*d* are changed by the moving velocities (mm/sec) of va1, vb1, vc1 and vd1 of the respective photosensitive drums, whereby it is possible to suppress the "hollow image", "density irregularity", and "color irregularity" at a good level for each image forming station.

<Embodiment 5>

Figure 9:
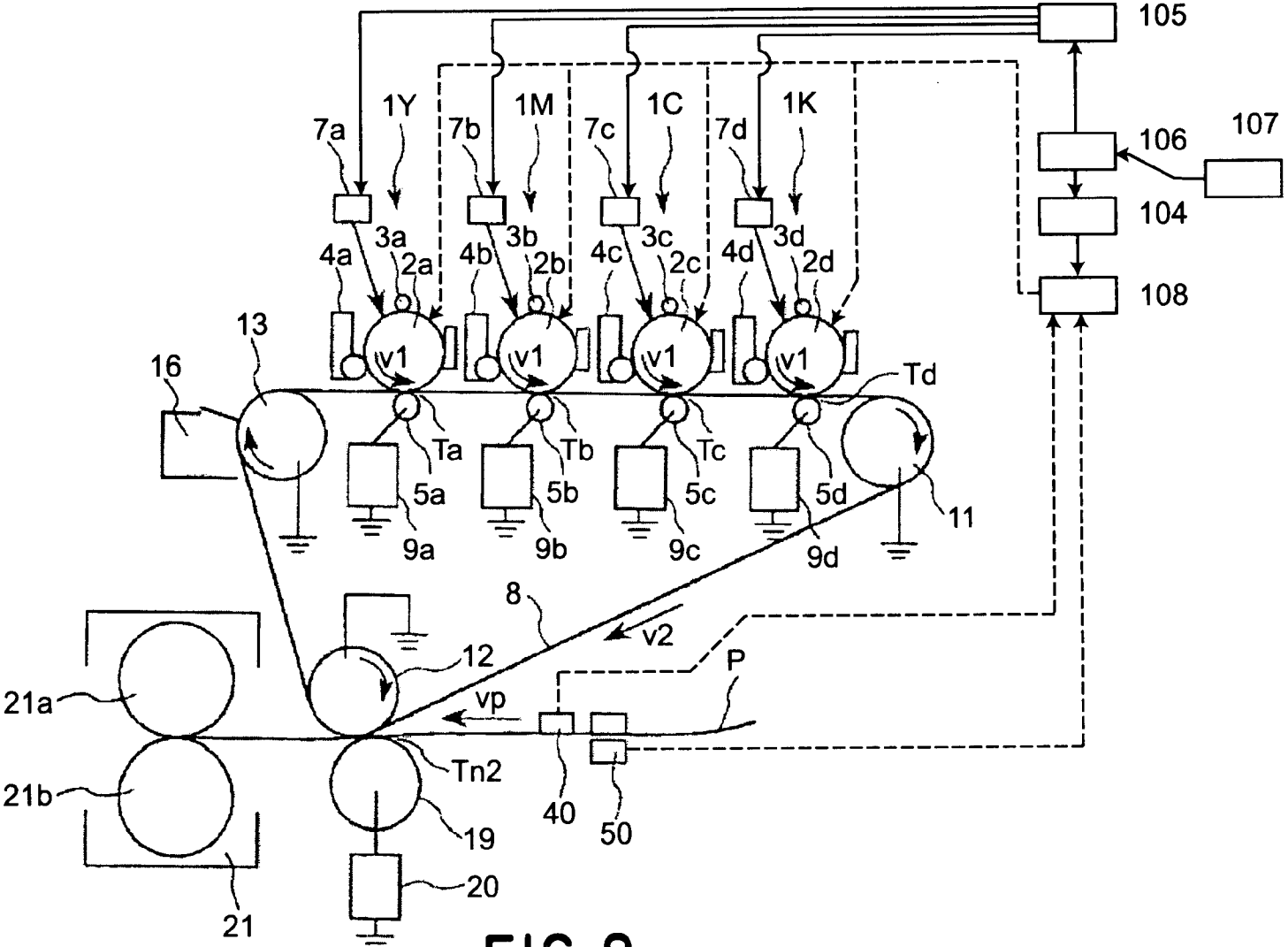

A fifth embodiment of the image forming apparatus of the present invention will be explained with reference to FIG. 9, wherein members and functions identical to those used in Embodiments 1–4 are represented by identical reference numerals and symbols and explanations therefor are omitted.

In this embodiment, the moving speed ratio γ12(%) is changed by performing a computation by the CPU 108 similarly as in Embodiment 1 on the basis of information from the detection means 104 for detecting image information and the kind of the transfer material thereby to change the surface moving speed v1 of the photosensitive drums 2*a* to 2*d*.

The "hollow image" level is largely different depending on an image pattern. This is because the "hollow image" occurs at a portion where a multitude of color toners are superposed (e.g., a secondary color portion of blue etc., or shadow (dark) portion of photographic image) but does not occur at a portion where the superposition of color toners is less (e.g., a monochrome (white and black) image portion or a highlight portion of photographic image). Accordingly, the moving speed ratio γ12 is set to be smaller with respect to the image with less superposition of color toners with each other, whereby the "color irregularity" level can be further improved without causing the "hollow image".

More specifically, in this embodiment, in an image processing unit 106 for converting image information sent rom a host computer 107 into YMCK data of four colors for imagewise exposure, reference to printing (coverage) rates of the YMCK data are made, and the image forming apparatus further includes an image information attention means 104 for detecting a total printing rate of four color toners at a portion where a total amount of four color toners superposed becomes maximum with respect to image patterns to be formed. On the basis of the detection results in advance of the image formation, the moving speed v1 of the photosensitive drums 2*a* to 2*d* is changed to change the moving speed ratio. Incidentally, in order to effect writing into the photosensitive drums 2*a* to 2*d*, information is separately sent from the image processing unit to a driver 105.

Herein, the printing rate may be defined, e.g., as 100% for a monochromatic (single color) solid image, 50% for an image when its optical (image) density is ½ of that of the solid image, and 200% for the secondary color solid image of, e.g., blue (magenta Solid image and cyan solid image superposed with each other).

If the total printing rate o the four color toner images at the maximum toner superposition portion among the various image patterns is low, the moving speed rate γ12 is set to be smaller to improve the level of "color irregularity" while retaining a state of no occurrence of the "hollow image". Further, if such a total printing rate is high, the moving speed ratio γ12 is set to be larger to suppress the occurrence of "hollow image" while keeping the "color irregularity" at a certain level.

In this embodiment, the setting of the moving speed ratio γ12 based on the total printing rate of the four color toner images in the normal environment is performed in accordance with the following equation:

$$\gamma 12=\alpha\times\beta,$$

wherein α and β are selected from the following Tables.

| (α values) Transfer material | | |
|---|---|---|
| (1) PP | (2) CP, OHP | (3) BP, LP |
| 100.25 | 100.00 | 100.50 |

| (α values) Total printing rate Ct (%) | | |
|---|---|---|
| C ≦ Ct < 100 | 100 ≦ Ct < 200 | 200 ≦ Ct |
| 1.005 | 1.010 | 1.013 |

As described above, in this embodiment, the image forming apparatus includes the image information detection means, and depending on the detection results thereof made in advance of image formation, the moving speed ratio γ12(%) is changed. As a result, both the "hollow image" and the "color irregularity" can be suppressed at good levels.

Further, the similar effect as in this embodiment can also be attained by changing the moving speed ratio γ12 through the change in moving speed v2 of the intermediary transfer belt 8.

<Embodiment 6>

Figure 10:
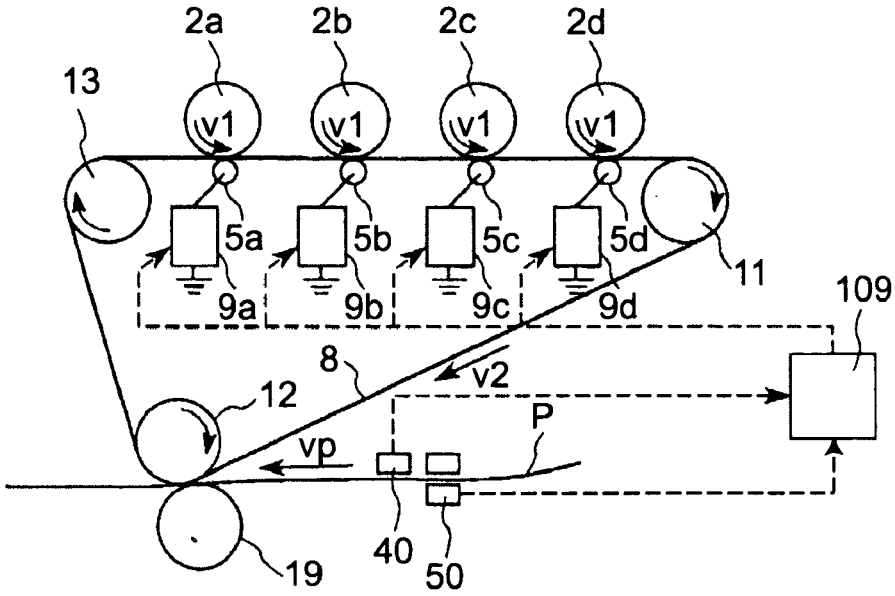

A sixth embodiment of the image forming apparatus of the present invention is shown in FIG. 10.

Figure 11:
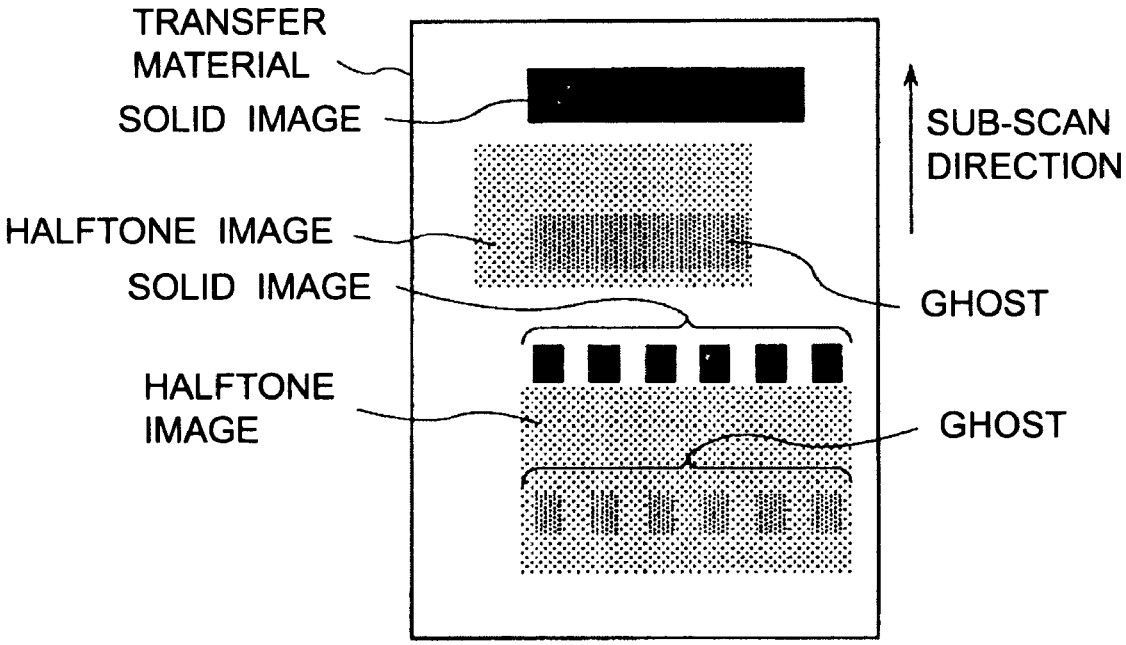
FIG. 11 is a schematic illustration of an image failure.

In this embodiment, referring to FIG. 10, on the basis of detection results of the kind of transfer material P by means of the reflection type optical transfer material sensor 40, the CPU 109 as the control means controls outputs of the transfer bias voltage power supplies 9*a* to 9*d*, whereby a primary transfer bias voltage vt1(V) is experimentally changed and the resultant image levels of the respective transfer materials P are evaluated. The results are shown in Table 4 below. Incidentally, as the transfer materials P, those of the three types (1), (2) and (3) identical to those used in Embodiment 1. The state of the "density irregularity" on the transfer material is similar to that shown in FIG. 5 described in Embodiment 1. Further the state of "ghost" on the transfer material is as shown in FIG. 11.

TABLE 4

| Primary transfer bias vt1(V) | (1) PP | (2) CP, OHP | (3) BP, LP |
|---|---|---|---|
| 150 | Noticeable DI *1 | Good*2 | Very noticeable DI *1 |
| 200 | Good*2 | Noticeable ghost | Noticeable DI *1 |
| 250 | Noticeable ghost | Very noticeable ghost | Good*2 |

*1 DI: density irregularity.
*2Good: DI or banding did not occur.

As shown in Table 4, the setting value of the primary transfer bias voltage Vt1 (V) providing a good image level is different depending on the kind of transfer material P used.

The results shown in Table 4 can be construed as follows.

The levels of surface smoothness of the transfer materials P ((1) plain paper, (2) coated paper, and (3) bond paper and laid paper), as described in Embodiment 1.

As shown in Table 4, at Vt1 (V)=200 V with respect to (1) plain paper, it is possible to obtain a good image level at which suppressions of occurrences of "density irregularity" and "ghost" can be compatibly effected. However, it is impossible to suppress "ghost" at vt1(V)=250 V, with respect to (1) plain paper.

On the other hand, with respect to other two types of the transfer materials P, i.e., (2) coated paper and OHP film and (3) bond paper and laid paper, the setting values of optimum vt1(V) for compatibly suppressing both the "density irregularity" and "ghost" are different from each other.

This may be attributable to the following reason.

The optimum setting value of vt1 (V) is 150 V with respect to (2) coated paper and OHP film. Compared with (1) plain paper, (2) coated paper and OHP film have smaller surface unevennesses, thus being less liable to cause scattering of toner particles at the time of the secondary transfer. Accordingly, "ghost" occurring within a toner image (particularly at the halftone image portion) on the intermediary transfer belt 8 as shown in FIG. 7, is liable to be faithfully reproduced even on these transfer materials. On the other hand, these transfer materials have smaller surface unevennesses, thus ensuring a good transfer efficiency at the time of the secondary transfer. Accordingly, even if "density irregularity" occurs in a toner image (particularly at the solid image portion) on the intermediary transfer belt 8 after the primary transfer, the "density irregularity" does not become worse and further noticeable on the transfer materials after the secondary transfer.

Therefore, with respect to (2) coated paper and OHP film, it is necessary to set a smaller Vt1 value (=150 V, than that for (1) plain paper, capable of predominantly realizing the suppression of the "ghost" rather than the "density irregularity" in the toner image on the intermediary transfer belt 8.

On the other hand, with respect to (3) bond paper and laid paper, the optimum setting value of vt1(V) is 250 V. The reason is as follows. These papers have larger surface unevennesses than (1) plain paper, thus being liable to lower the transfer efficiency at the time of the secondary transfer. Accordingly, the "density irregularity" occurring within the toner image (particularly at the solid image portion) on the intermediary transfer belt 8 is visualized after the secondary transfer, thus being more liable to become worse on the transfer materials P.

On the other hand, these transfer materials having larger surface unevennesses is liable to cause toner scattering or the like at the time of the secondary transfer. As a result, even if the "ghost" occurs within the toner image (particularly at the halftone image portion) on the intermediary transfer belt 8, the "ghost" is not reproduced faithfully on the transfer materials after the secondary transfer, thus being less noticeable.

Therefore, with respect to (3) bond paper and laid paper, it is necessary to set a larger vt1(V) value (−250 V), than that for (1) plain paper, capable o predominantly realizing the suppression of the "density irregularity" rather than the "ghost".

In the image forming apparatus of this embodiment, depending on the kinds of the transfer materials detected by the reflection type optical transfer material sensor 40, control of the primary transfer bias voltage vt1(V) is performed so that the setting value thereof is changed to those shown in Table 5.

As shown in Table 5, with respect to (2) coated paper and OHP film having higher surface smoothness, the primary transfer bias voltage vt1(V) is set to a value which is lower than that for the plain paper, a transfer member is suppressed to improve the level of "ghost" without accentuating the "density irregularity" at the time of the secondary transfer.

On the other hand, with respect to (3) bond paper and laid paper, the primary transfer bias voltage vt1(V) is set to be higher than that for the plain paper, whereby the primary transfer efficiency is improved to remedy the "density irregularity" without accentuating the "ghost" at the time of the secondary transfer.

As described above, in the image forming apparatus of this embodiment, such a control that the primary transfer bias voltage vt1(V) is changed so that the vt1 value for the higher surface smoothness transfer material is lower than that for the plain paper and the vt1 value for the lower surface smoothness transfer material is higher than that for the plain paper, depending on the kind of transfer materials, i.e., the difference in surface smoothness in this embodiment, detected by the transfer material kind detection means provided in the image forming apparatus, is performed, thus allowing suppression of the "ghost" and "density irregularity" to good levels.

Incidentally, the means for detecting the surface properties of various kinds of the transfer materials includes the reflection type optical sensor 40 and the transmission type optical sensor 50 described in Embodiment 1.

In the image forming apparatus of this embodiment, the electric resistances of the primary transfer rollers 5*a*, 5*b*, 5*c* and 5*d* at the respective image forming stations 1Y, 1M, 1C and 1K are identical to each other.

However, even in the image forming apparatus including these primary transfer rollers 5*a* to 5*d* having different resistances, it is possible to attain a similar effect by controlling the bias voltages so that a transfer electric field at the time of using (2) coated paper and OHP film is lower than that for the plain paper, and a transfer electric field at the time of using (3) bond paper and laid paper is higher than that for the plain paper, while focusing attention on the transfer electric field coated at the primary transfer station.

This is because the physical phenomena such as a toner transferability and a transfer memory of the photosensitive drum are essentially caused by the action of the transfer electric field within the primary transfer nip portion. Accordingly, it is also possible to control the transfer electric field at the primary transfer station by switching the charge potentials of the photosensitive drums 2*a* to 2*d* through the charge rollers 3*a* to 3*d*, respectively.

Incidentally, in this embodiment, the primary transfer bias voltage vt1(V) is used common to all the color image forming stations but it is more preferable that the setting value of the primary transfer bias voltage Vt1(V) is changed depending on the colors of toner images since the primary transfer bias voltage can further improve the level of resultant image when the primary transfer bias voltage is suited to the characteristic of the toner to be transferred.

<Embodiment 7>

A seventh embodiment of the image forming apparatus of the present invention is identical to that of Embodiment 6 except for the manner of discriminating the kind of transfer material used. Such a discrimination manner will be described with reference to FIG. 14 in which the same reference numerals and symbols as in FIG. 10 represent the same members and functions as in FIG. 10.

Figure 14:
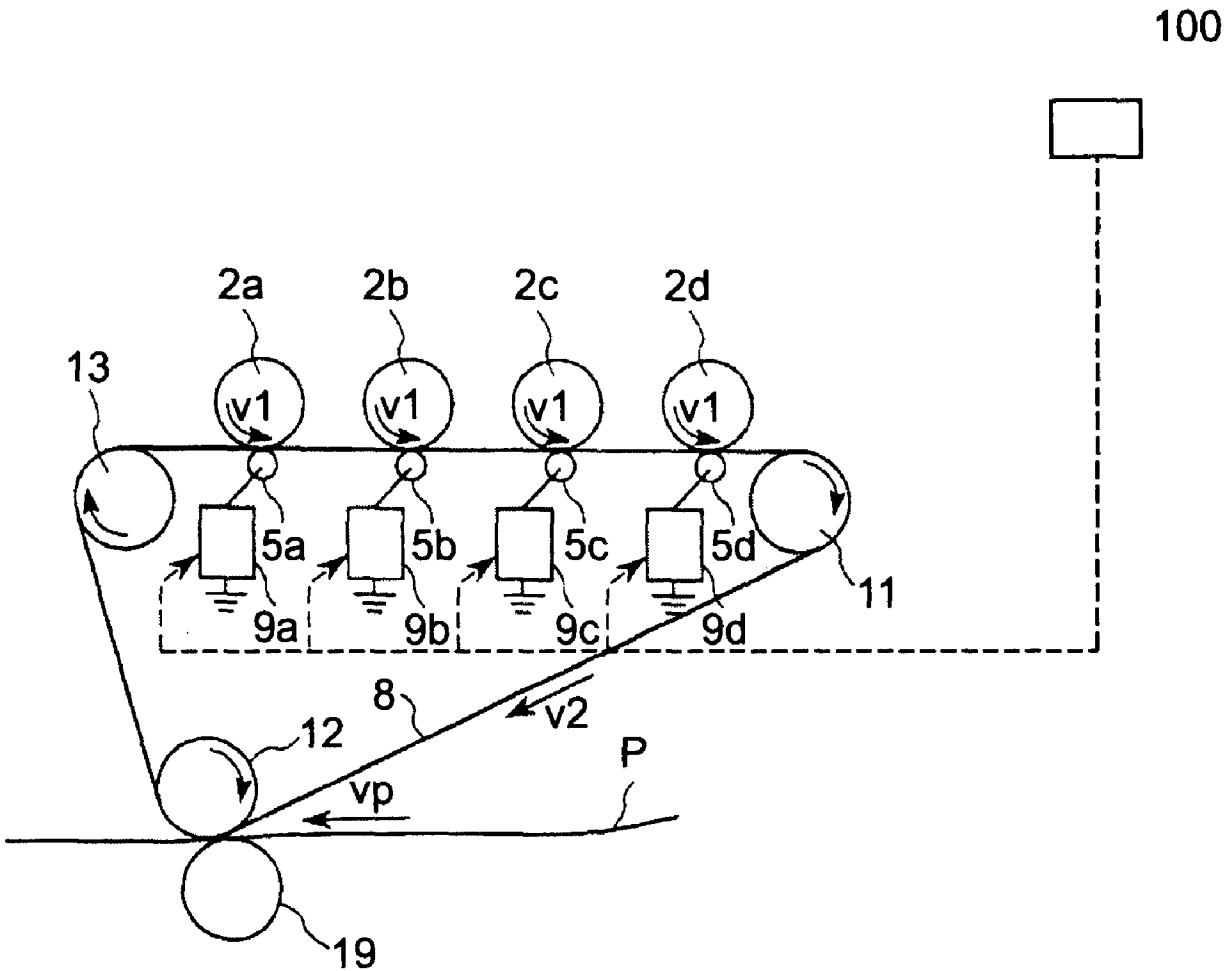
FIGS. 14 and 15 are schematic sectional views of the image forming apparatuses of the present invention used in Embodiments 7 and 8, respectively.

The image forming apparatus shown in FIG. 14 includes input means 100 for inputting information the transfer material used, and the input of the information is performed by a user through the setting o the kind of the transfer material. In this embodiment, the transfer material information input means is used as an independent input means but may also include such a case that the operation panel of the copying machine (image forming apparatus) has also the function as the transfer material information input means.

The transfer material information input means 100 is designed so as to permit classification of the surface properties of the transfer material, so that it is possible to input the distinction among the transfer materials, such as glossy paper, OHP film, etc. When the transfer material information is inputted into the transfer material information input means 100, based on the inputted information, the primary transfer bias voltage vt1(V) is controlled in the same manner as in Embodiment 6.

<Embodiment 8>

Figure 15:
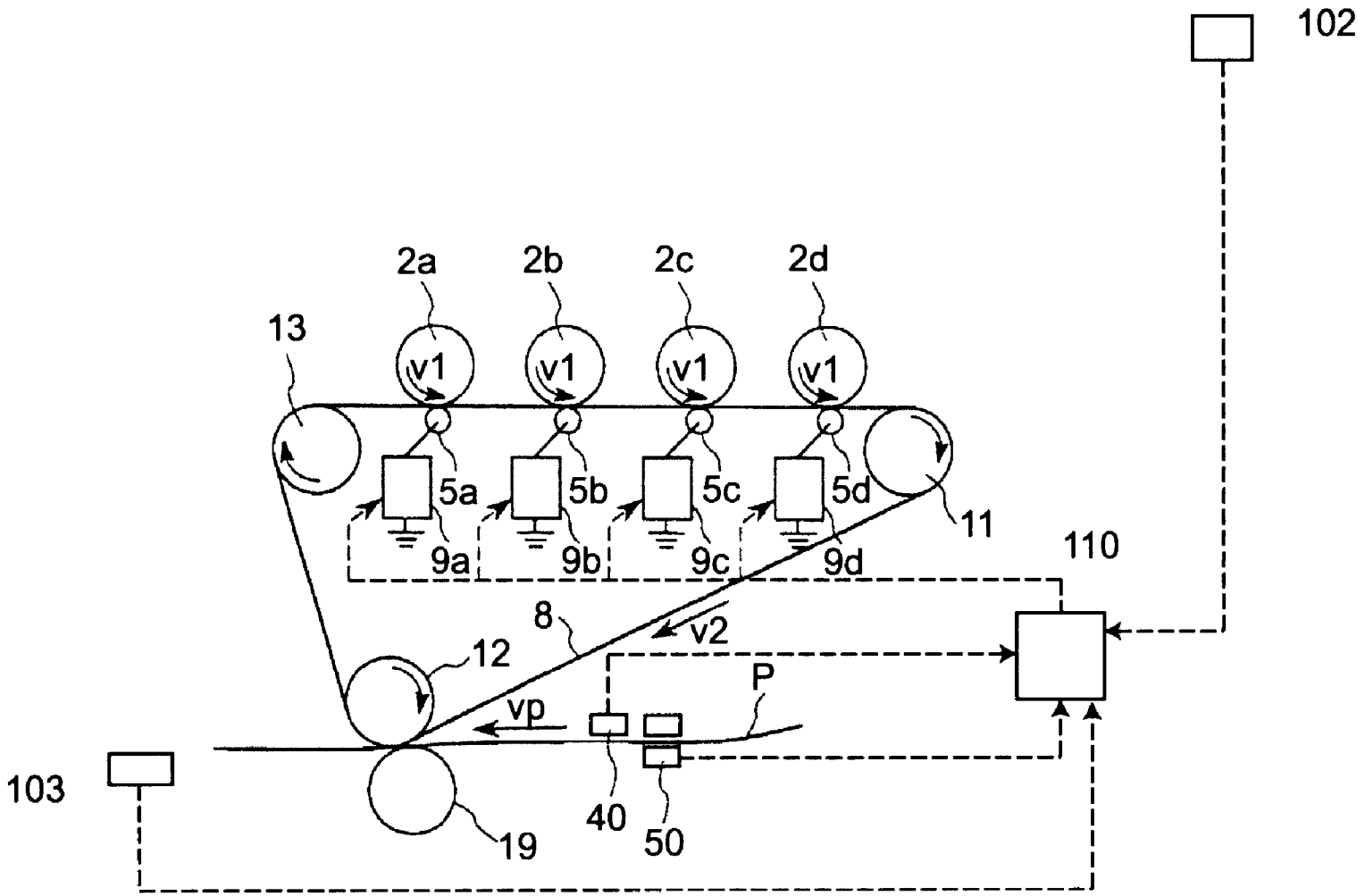

A eighth embodiment of the image forming apparatus of the present invention is identical to the image forming apparatus of Embodiment 6 except for adding means for detecting ambient temperature/humidity and means for discriminating the number of continuous image formation, and will be described with reference to FIG. 15, wherein reference numerals and symbols identical to those in FIGS. 8 and 10 represent the same members and functions as in FIGS. 8 and 10.

The image forming apparatus of this embodiment is identical to that of Embodiment 6 in respect of such a control that the primary transfer bias voltage is changed depending on the kind of transfer material used. In this embodiment, the image forming apparatus further includes an environment detection sensor 102 for detecting the environment of the image forming apparatus and a fed paper counting means 103, outputs of which are utilized as parameters for controlling the primary transfer bias voltage. The primary transfer bias voltage is controlled by a CPU 110 into which outputs of the environment detection means 102 and the fed paper counting means 103 and the information on the transfer material used are inputted. More specifically, an absolute humidity is calculated from the results of temperature and humidity detected by the environment detection sensor, and if the value of the absolute humidity is high, the primary transfer bias voltage vt1 is controlled by multiplying it by a corresponding coefficient of the calculated absolute humidity so as to lower the primary transfer bias voltage value vt1. This may be attributable to the following phenomenon. If the absolute humidity is high, the amount of electric charge per unit weight of the toner is low, thus resulting in a smaller amount thereof required for the primary transfer. Further, in the case where an ion conduction type roller is used for the primary transfer, when the temperature is increased, the resultant electroconductivity is also increased. As a result, the level of "ghost" becomes worse unless the primary transfer bias voltage is lowered.

On the other hand, in this embodiment, the primary transfer bias voltage is also controlled by the output of the fed paper counting means 103. From the number of fed paper, the thickness of the photosensitive drums 2*a* to 2*d* is estimated, whereby the primary transfer bias voltage is controlled. If the photosensitive drum thickness is changed, the impedance of the photosensitive drum is also changed. More specifically, the thickness of the photosensitive drums 2*a* to 2*d* is decreased with the time of continuous image formation, the resultant impedance value is lowered, so that the output of the primary transfer bias voltage is controlled to be lowered in correspondence with the lowered impedance value. This is because if the output of the primary transfer bias voltage is fixed at a certain value irrespective of the lowering in impedance, the current value flowing into the photosensitive drums 2*a* to 2*d* is excessively increased, thus worsening the "ghost" level.

As described hereinabove, the image forming apparatus of the present invention described based on Embodiments 1–8 are not limited to the image forming apparatus of an in-line system including the plurality of first image bearing members but may be applicable to those of one drum-type or two drum-type wherein toner images are successively formed on one or two first image bearing members by using a plurality of developing apparatuses. Further, the present invention is not limited to the above-mentioned embodiments but may be modified within the scope of the present invention.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

a movable intermediary transfer member, wherein an image on said image bearing member is transferred onto said intermediary transfer member by a primary transfer and the image transferred onto said intermediary transfer member is transferred onto a transfer material by a secondary transfer;

discrimination means for discriminating a kind of the transfer material; and control means for controlling a moving speed ratio between said image bearing member and said intermediary transfer member on the basis of an output of said discrimination means.

2. An apparatus according to claim 1, wherein said discrimination means is external input means provided to said image forming apparatus.

3. An apparatus according to claim 1, wherein said discrimination means is a light reflection type optical sensor.

4. An apparatus according to claim 1, wherein said discrimination means is a light transmission type optical sensor.

5. An apparatus according to claim 1, wherein said primary transfer is performed a plurality of times before the secondary transfer, and said control means independently controls the moving speed ratio.

6. An apparatus according to claim 1, further comprising an environmental sensor for detecting an ambient environment of said image forming apparatus, said control means controls the moving speed ratio on the basis of an output of said environmental sensor.

7. An apparatus according to claim 1, further comprising a developing apparatus, and said control means controls the moving speed ratio on the basis of a cumulative operation time of said developing apparatus.

* * * * *

UNITED STATES PATENT AND TRADEMARK OFFICE

CERTIFICATE OF CORRECTION

PATENT NO. : 6,980,749 B2
APPLICATION NO. : 10/669015
DATED : December 27, 2005
INVENTOR(S) : Yasuo Yoda et al.

It is certified that error appears in the above-identified patent and that said Letters Patent is hereby corrected as shown below:

ON THE COVER PAGE:

UNDER REFERENCES CITED, ITEM (56):

"JP 04305666 10/1992" should read --JP 04-305666 10/1992---; and
"JP 09134079 5/1997" should read --JP 09-134079 5/1997--.

COLUMN 2:

Line 14, "vie" should read --view--;
Line 17, "view" should read --view of--; and
Line 39, "section" should read --sectional--.

COLUMN 3:

Line 9, "contacts" should read --contact--; and
Line 65, "sing" should read --using--.

COLUMN 5:

Line 38, " "sub" should read --"sub- --.

COLUMN 6:

Line 16, "result" should read --result,--.

COLUMN 9:

Line 1, "o" should read --of--; and
Line 15, "a" should read --at--.

UNITED STATES PATENT AND TRADEMARK OFFICE

CERTIFICATE OF CORRECTION

PATENT NO. : 6,980,749 B2
APPLICATION NO. : 10/669015
DATED : December 27, 2005
INVENTOR(S) : Yasuo Yoda et al.

It is certified that error appears in the above-identified patent and that said Letters Patent is hereby corrected as shown below:

COLUMN 12:

Line 8, “belt 8” should read --belt 8.--; and
Line 44, “select” should read --selects--.

COLUMN 13:

Line 65, “rom” should read --from--.

COLUMN 14:

Line 19, “o” should read --of--; and
Line 48, “(α values)” should read --(β values--.

COLUMN 15:

Line 10, “identical” should read --are identical--.

COLUMN 16:

Line 26, “o” should read --of--.

COLUMN 17:

Line 37, “o” should read --of--; and
Line 54, “A” should read --An--.

UNITED STATES PATENT AND TRADEMARK OFFICE

CERTIFICATE OF CORRECTION

PATENT NO. : 6,980,749 B2
APPLICATION NO. : 10/669015
DATED : December 27, 2005
INVENTOR(S) : Yasuo Yoda et al.

It is certified that error appears in the above-identified patent and that said Letters Patent is hereby corrected as shown below:

COLUMN 19:

Line 6, "external" should read --an external--.

Signed and Sealed this

Twenty-fifth Day of July, 2006

JON W. DUDAS
*Director of the United States Patent and Trademark Office*